US005799855A

United States Patent [19]

Veoukas et al.

[11] Patent Number: 5,799,855

[45] Date of Patent: Sep. 1, 1998

[54] VELOCITY CONTROL AND NOSEPIECE STABILIZER SYSTEM FOR COMBUSTION POWERED TOOLS

[75] Inventors: Stanley C. Veoukas, Wheeling; Kui-Chiu Kwok, Mundelein; Donald L. Van Erden, Wildwood; George M. Velan, Mount Prospect, all of Ill.

[73] Assignee: Illinois Tool Works Inc., Glenview, Ill.

[21] Appl. No.: 599,022

[22] Filed: Feb. 9, 1996

[51] Int. Cl.[6] ..... B25C 1/04

[52] U.S. Cl. ..... 227/10; 227/8; 227/130; 227/142

[58] Field of Search ..... 227/8, 130, 129, 227/10, 120, 142; 173/210, 211

[56] References Cited

U.S. PATENT DOCUMENTS

| | | | |
|---|---|---|---|
| Re. 32,452 | 7/1987 | Nikolich | 123/46 |
| 3,040,327 | 6/1962 | Michel | 1/107 |
| 3,061,833 | 11/1962 | DeCaro | 1/44.5 |
| 3,438,449 | 4/1969 | Smith | 173/17 |
| 3,558,032 | 1/1971 | Oefinger | 227/8 |
| 3,563,438 | 2/1971 | Doyle et al. . | |
| 3,622,060 | 11/1971 | Gussalli | 227/8 |
| 3,675,838 | 7/1972 | Bakoledia | 227/8 |
| 3,788,404 | 1/1974 | Koudelka et al. | 173/139 |
| 3,923,226 | 12/1975 | Maier | 227/8 |
| 4,040,655 | 8/1977 | Rothfuss et al. | 227/130 |
| 4,068,790 | 1/1978 | Osterle et al. | 227/8 |
| 4,074,842 | 2/1978 | Olivier et al. | 227/8 |
| 4,074,844 | 2/1978 | Hodil, Jr. | 227/8 |
| 4,239,143 | 12/1980 | Johnson | 227/10 |
| 4,320,864 | 3/1982 | Novak et al. . | |
| 4,341,336 | 7/1982 | Smith . | |
| 4,403,722 | 9/1983 | Nikolich | 227/8 |
| 4,475,680 | 10/1984 | Farian | 227/130 |
| 4,483,473 | 11/1984 | Wagdy | 227/8 |
| 4,522,162 | 6/1985 | Nikolich | 123/46.5 |
| 4,566,619 | 1/1986 | Kleinholz | 227/8 |
| 4,610,381 | 9/1986 | Kramer | 227/130 |
| 4,773,581 | 9/1988 | Ohtsu et al. | 227/10 |
| 4,778,094 | 10/1988 | Fishback | 227/66 |
| 4,962,787 | 10/1990 | Mayhew . | |
| 5,000,128 | 3/1991 | Veldman . | |
| 5,090,606 | 2/1992 | Torii et al. | 227/10 |
| 5,131,579 | 7/1992 | Okushima et al. | 227/8 |
| 5,261,587 | 11/1993 | Robinson . | |
| 5,263,439 | 11/1993 | Doherty et al. | 123/146 |
| 5,263,626 | 11/1993 | Howard et al. | 227/8 |
| 5,263,842 | 11/1993 | Fealey . | |
| 5,320,268 | 6/1994 | Shkolvikov et al. | 227/66 |
| 5,332,140 | 7/1994 | Almeras et al. | 227/9 |
| 5,437,339 | 8/1995 | Tanaka | 173/210 |
| 5,495,973 | 3/1996 | Ishizawa et al. | 227/130 |
| 5,579,975 | 12/1996 | Moorman | 227/8 |

FOREIGN PATENT DOCUMENTS

| | | |
|---|---|---|
| 0 354 821 A2 | 8/1989 | European Pat. Off. . |
| 0 354 821 A3 | 2/1990 | European Pat. Off. . |
| 366803 | 2/1963 | Switzerland . |

*Primary Examiner*—Scott A. Smith
*Attorney, Agent, or Firm*—Schwartz & Weinrieb

[57] ABSTRACT

A piston velocity control and stability control system is provided for a combustion powered tool having a self contained combustion engine. The system includes a ring that may be adjusted relative to exit ports in a cylinder of the combustion engine. The ring includes openings which may be incrementally aligned between a completely exposed, and a substantially closed position relative to the exit ports. Displaced air volume within the cylinder exits through the exit ports as a piston advances down the cylinder, and the velocity of the piston will be greatest when the exit ports are completely exposed. User initiated reduction of the effective size of the exit ports by adjustment of the ring will reduce piston velocity as described per application. A nosepiece used to guide the driver blade and position the blade over a fastener is isolated from the cylinder so that the nosepiece remains stable relative to the workpiece upon combustion and until the driver blade strikes the fastener.

13 Claims, 4 Drawing Sheets

VELOCITY CONTROL AND NOSEPIECE STABILIZER SYSTEM FOR COMBUSTION POWERED TOOLS

FIELD OF THE INVENTION

The present invention relates generally to improvements in portable combustion powered fastener driving tools, and more specifically to improvements relating to the control of power output and the maintenance of stable alignment of such a tool with respect to a workpiece.

BACKGROUND OF THE INVENTION

Portable combustion powered, or so-called IMPULSES brand tools for use in driving fasteners into workpieces are described in commonly assigned patents to Nikolich U.S. Pat. Re. No. 32,452, and U.S. Pat. Nos. 4,552,162, 4,483,473, 4,483,474, 4,403,722, and 5,263,439, all of which are hereby incorporated herein by reference. Similar combustion powered nail and staple driving tools are also available commercially from ITW-Paslode of Lincolnshire, Ill. under the IMPULSE® brand.

Such tools incorporate a tool housing enclosing a small internal combustion engine. The engine is powered by a canister of pressurized fuel gas, also called a fuel cell. A battery-powered electronic power distribution unit produces the spark for ignition, and a fan located in the combustion chamber provides for both an efficient combustion within the chamber, and facilitates scavenging, including the exhaust of combustion by-products. The engine includes a reciprocating piston with an elongate, rigid driver blade disposed within a piston chamber of a cylinder body.

A valve sleeve is axially reciprocable about the cylinder and, through means of a linkage, moves to close the combustion chamber when a work contact element at the end of the linkage is pressed against a workpiece. This pressing action also triggers a fuel metering valve to introduce a predetermined volume of fuel gas into the closed combustion chamber.

Upon the pulling of a trigger switch, which causes the ignition of a charge of gas in the combustion chamber of the engine, the piston and driver blade are shot downward so as to impact a positioned fastener and drive it into the workpiece. As the piston is driven downward, a displacement volume enclosed in the piston chamber below the piston is forced to exit through one or more exit ports provided at the lower end of the cylinder. After impact, the piston then returns to its original, or "ready" position through differential gas pressures within the cylinder. Fasteners are fed magazine-style into the nosepiece, where they are held in a properly positioned orientation for receiving the impact of the driver blade.

Combustion powered tools may be contrasted from conventional powder activated technology (PAT) tools, which employ a gunpowder powered cartridge to propel a driving member to drive a fastener into a workpiece. PAT tools generate an explosion in a combustion chamber which creates high pressures for propelling the driving member at a high velocity toward the fastener. The relatively small volume of the combustion chamber and the explosive combustion combine to create a rapid acceleration of the driving member for achieving the velocity required for proper fastener driving. In contrast, combustion powered tools typically provide a much slower acceleration of the driving member. This is due to the relatively large size of the combustion chamber, and to the requirement of the preferred fuel to obtain atmospheric oxygen for combustion (the powder in PAT tools incorporates its own oxygen). Thus, in combustion powered tools, the combustion event is a relatively gradual process. Commercially available combustion powered tools have relatively short cylinder bodies, so that the driving member is incapable of achieving velocities which are comparable to those of PAT tools.

A high velocity combustion powered tool of the type described above and featuring an extended piston chamber or cylinder is the subject of a co-pending patent application Ser. No. 08/536,854, filed Sep. 29, 1995. The extended cylinder increases the stroke of the piston, thereby allowing for increased piston velocity and transfer of power from the driver blade to the fastener. In one embodiment, the extended length also allows an operator to stand generally upright while driving fasteners which are at foot level.

A number of factors influence piston velocity, including piston diameter and stroke, but these factors are fixed by design in a particular tool. One way to vary the power of a combustion powered tool is by means of controlling the speed of the fan in the combustion chamber, as described in copending U.S. application Ser. No. 08/337,289, filed Nov. 10, 1994. A circuit is used to vary fan speed, and increased fan speed produces additional power. However, in most conventional combustion powered tools, the piston velocity is fixed by design.

In conventional combustion powered tools, the fixed piston velocity prevents an operator from controlling the driving depth of the fastener being driven into a particular type of workpiece or substrate. In addition, depending on the composition of the workpiece or substrate, the lack of velocity control may prevent an operator from obtaining a desired consistent driving depth. An identical driver blade velocity, when translated into a force applied to a fastener being driven into wood, for instance, will result in a different depth when applied to a fastener being driven into a steel beam. Such velocity will result in still another depth when applied to a fastener being driven into sheet metal being fastened to a roof truss. Thus, depending on the design of the tool, there may be insufficient power to properly drive a fastener into all desired workpieces.

An additional problem, limited primarily to the high velocity, extended cylinder tools, concerns stability of the tool during operation. The increased stroke of extended length combustion tools, used to increase both velocity and power transfer, also increases the delay between combustion and the driving of a fastener into the substrate. This increased delay can reduce the amount of control and applied power of the tool, because the tool recoils in reaction to the combustion, causing the tool nosepiece to move with respect to the workpiece before the fastener is actually driven. Drawbacks of such operations are misaligned or incompletely driven fasteners.

OBJECTS OF THE INVENTION

Accordingly, it is an object of the present invention to provide an improved combustion powered tool which provides operator control over the fastener driving depth.

Another object of the present invention is to provide an improved combustion Powered tool in which the velocity of the piston and driver blade may be varied by operator adjustment of the volume of displaced air exiting the cylinder.

A further object of the present invention is to provide an improved combustion powered tool wherein the nosepiece remains stationary after combustion and until impact of the driver blade with the fastener.

An additional object of the present invention is to provide an improved extended stroke combustion powered tool having a nosepiece which is mechanically isolated from the remaining portions of the tool, and which remains stationary until impact of the driver blade with a fastener.

SUMMARY OF THE INVENTION

The above-listed objects are met or exceeded by the present improved combustion powered fastener tool, which allows for adjustment of the effective exit port size through which a displaced air volume exits the cylinder as the piston and driver blade advances down the cylinder toward impact with a fastener. One or more exit ports are provided near a terminal end of the cylinder. An exit port adjustment ring circumscribes the cylinder and has openings corresponding to the exit ports. In a first position, the openings align with the exit ports so that the exit ports are fully exposed. Rotatable adjustment of the ring to other positions will cause portions of the ring to partially block the exit ports, thereby reducing their effective size. As the effective size of the exit ports is reduced, resistance to the flow of displacement volume out of the cylinder increases, and creates a corresponding increase in resistance to the travel of the piston toward the terminal end of the piston chamber. Thus, the velocity of the piston and the subsequent applied impact force may be reduced incrementally by successively reducing the effective size of the exit ports by means of the adjustment of the ring.

More specifically, the present invention provides a combustion powered tool having a self-contained internal combustion power source constructed and arranged for creating a combustion event for driving a driver blade to impact a fastener and drive it into a workpiece. The tool includes a housing having a main chamber enclosing the power source, and a cylinder within the main chamber enclosing a piston for driving the driver blade the length of the cylinder. Advancement of the piston displaces a displacement volume of air disposed in the cylinder on one side of the piston. The tool also includes at least one displacement volume exit port disposed in the cylinder for allowing the displacement volume to exit the cylinder when displaced by the advancing piston, and features an adjusting device for adjusting the resistance to the exit of the displacement volume from the cylinder through the at least one exit port.

According to another feature of the present invention, the nosepiece which guides the driver blade to strike a fastener remains in position against the workpiece upon combustion and until the fastener is struck, even when an extended length cylinder is used. The nosepiece is mechanically isolated from the piston chamber and the remaining portions of the tool. A preferred structure for effecting the mechanical isolation is at least one spring. One or more springs disposed between the nosepiece and the remaining portions of the tool absorb tool recoil occurring in response to the combustion which drives the piston. While combustion may cause the remainder of the tool to move with respect to the fastener and the workpiece or substrate, the spring separates the nosepiece from the movement so that the nosepiece remains stationary with respect to the fastener and substrate until impact.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 2:
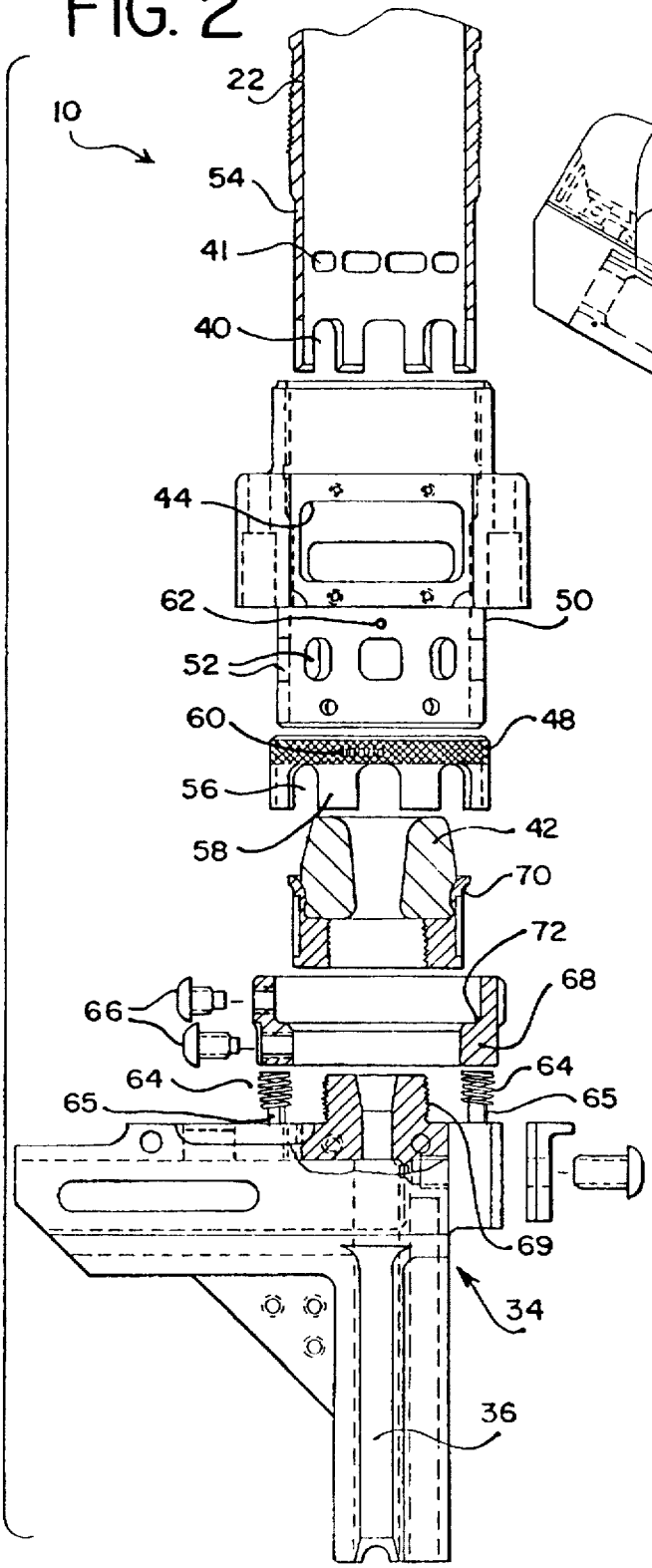
FIG. 2 is an exploded side fragmentary view showing the nosepiece end portion of the tool of FIG. 1.
Figure 1:
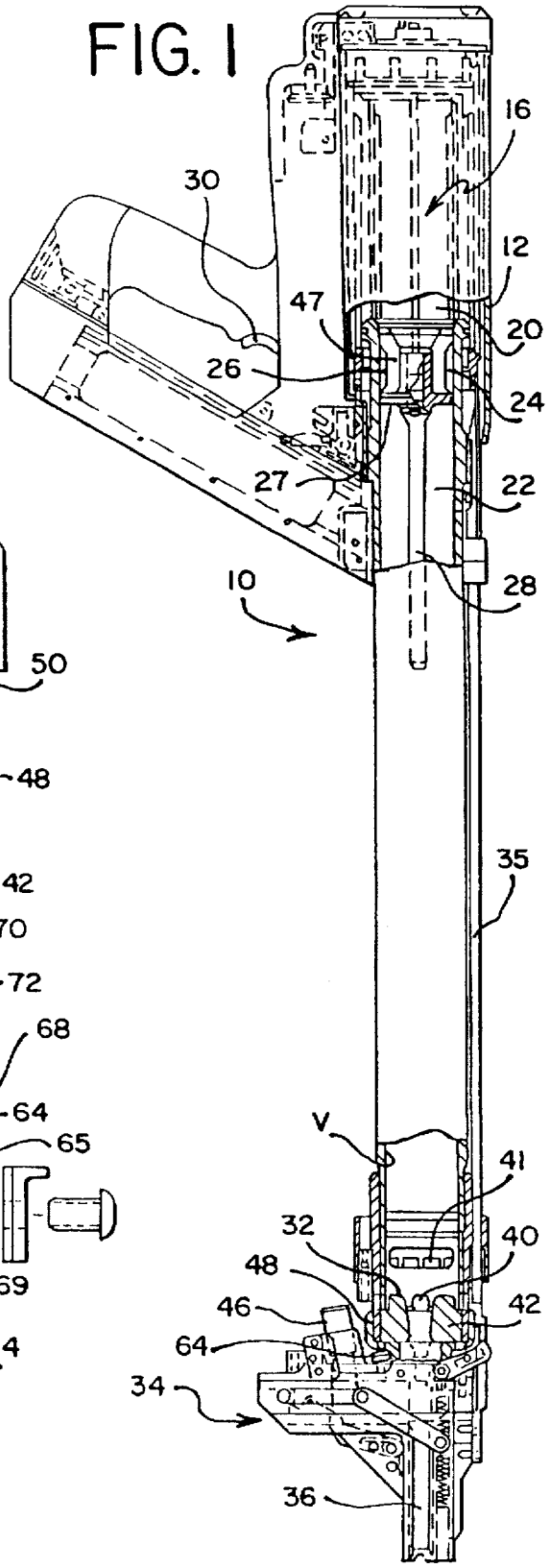
FIG. 1 is a side view of an extended stroke combustion fastener tool in accordance with the present invention, with portions shown in partial cross-section.
Figure 3:
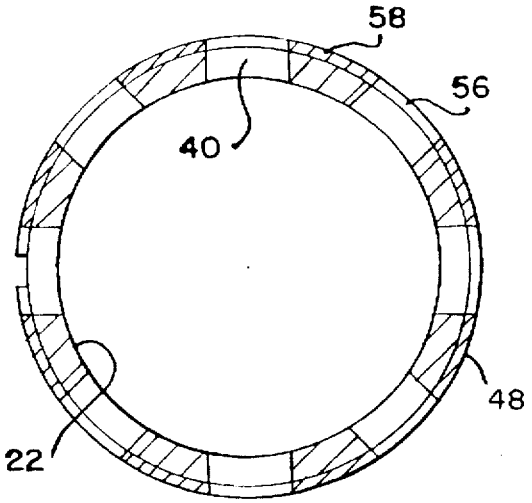
FIGS. 3–7 are schematic sectional views showing the relationship between the displacement volume exit ports and an exit port adjustment ring in different states of exit port adjustment ring rotation.
Figure 4:
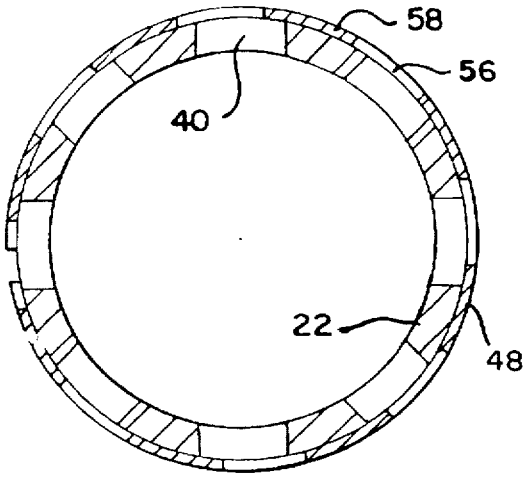
Figure 5:
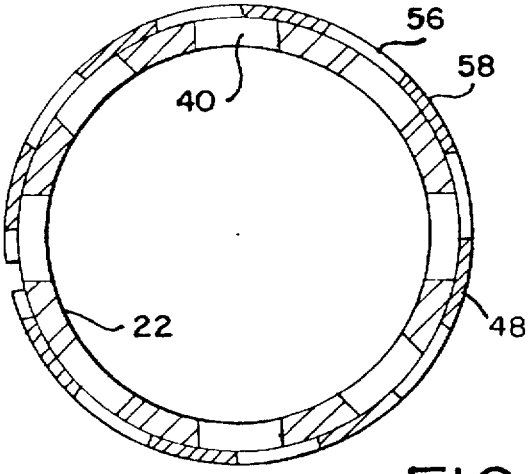
Figure 6:
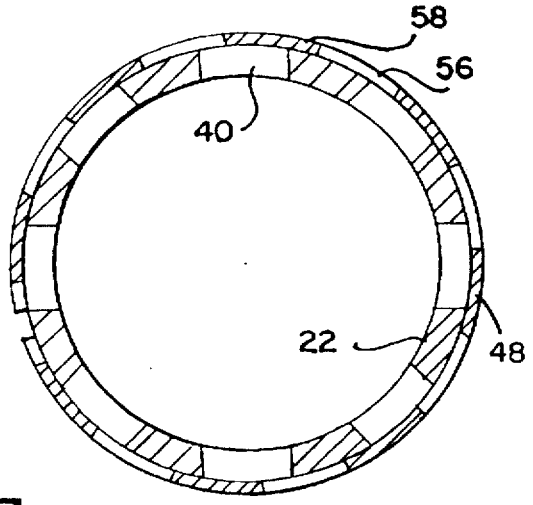

Referring now to FIGS. 1 and 2, the preferred embodiment of an extended length high velocity combustion fastener tool suitable for practicing the present invention is generally designated 10. A main housing 12 of the tool 10 encloses a self contained internal power source 16. The power source includes a combustion chamber 20 that communicates with a cylinder 22. A piston 24, including exhaust gas cutouts 26, is disposed within the cylinder 22 and is connected to a driver blade 28. In the preferred embodiment, the cylinder 22 is of the extended length type and as such is considerably longer than the driver blade 28. Below the cutouts 26, a peripheral lower edge of the piston 24 includes at least one piston ring (not shown) for creating a seal with inner walls of the piston chamber 22.

Through depression of a trigger 30, an operator induces combustion of a measured amount of propellant, such as MAPP gas, within the combustion chamber 20. In response, the piston 24 is driven toward a terminal end 32 of the cylinder 22. As the piston 24 approaches the terminal end 32, the driver blade 28 will be guided into a nosepiece 34 and impact a fastener (not shown) held above a workpiece by the nosepiece 34. Although it is contemplated that the present tool will be used with a variety of fasteners, it is preferred that the fastener be of the so-called pin type, described in more detail in U.S. Pat. No. 5,199,625, which is incorporated herein by reference. Impact of the driver blade 28 drives the fastener into a workpiece or substrate. As a safety feature, and to regulate the use of fuel, the firing of the tool will not occur unless the nosepiece 34 is pressed against a workpiece. Such placement causes a linkage rod 35 to be pushed upward, which moves a valve sleeve (not shown) to seal the combustion chamber 20. Details concerning sealing of the combustion chamber 20, and related mechanisms may be found in the previously mentioned Nikolich patents, which are incorporated herein by reference.

A displaced volume of air V is defined within the cylinder 22, and below a lower side 27 of the piston 24. Upon ignition of fuel in the combustion chamber 20, the air in volume V is driven down the cylinder 22 and out through displacement volume exit ports 40 and through exhaust ports 41 by the advancement of the piston 24 toward the terminal end 32 of the cylinder 22. A bumper 42 defines the end of travel of the piston 24 toward the terminal end 32. The exhaust ports 41 are exposed to the outside under the control of a reed valve (not shown), or other suitable type of valve, located in a port 44. When the piston 24 reaches the terminal end 32, exhaust gas from the combustion chamber 20 flows past the piston 24 through the cutouts 26 in the piston 24 and through the exhaust ports 41, which are located above the piston 24 at its terminal end position. Also, once the piston 24 reaches the bottom of its stroke, the displacement volume V will have exited through either the exit ports 40, which are located below the terminal end 32, or through the exhaust ports 41. The displacement volume V can only exit the exhaust ports 41 prior to the piston passing the ports 41 as it advances toward the terminal end 32.

Any exhaust gas remaining behind the piston 24 (on the combustion side) will then exit through the reed valve due to its higher temperature and pressure. As the gas in the combustion chamber 20 cools, the reed valve closes, and the gas volume decreases, creating a vacuum in the combustion chamber 20 which draws the piston 24 back to its start position. Return of the piston 24 close to the combustion chamber 20 places the tool 10 in a ready position for another firing, and additional fasteners fed into the nosepiece 34 from a tubular magazine 46 may be driven in an identical manner.

The tool 10 illustrated in FIG. 1 is a so-called extended length cylinder embodiment. The extended length cylinder 22 allows an operator standing generally upright to operate the tool 10 to drive fasteners at foot level. An important additional feature of the extended length tool 10 is the increase in the stroke of the piston 24. Through the increased stroke, velocity of the piston 24 at impact and efficiency of power transfer is enhanced, when compared to an otherwise identical combustion powered tool having a smaller stroke.

For instance, a known standard length cylinder tool available commercially from ITW-Paslode of Lincolnshire, Ill., has a stroke of approximately 3.5 inches. The combustion chamber volume is approximately 17 cubic inches. Of an available approximately 120 joules of energy available at combustion, such a tool imparts approximately 41.7% (about 50 joules) to a fastener. Keeping all other factors identical, an extended cylinder tool with a stroke of approximately 7 inches imparts approximately 83.3% of the available 120 joules to a fastener. The extended length of the stroke allows the piston 24 and the associated driver blade 28 to attain greater velocity and a higher rate of acceleration prior to striking the fastener than available from conventional "standard length cylinder" combustion powered tools. By lengthening the piston stroke, combustion powered tools may now achieve driver blade velocities which are comparable to those of PAT tools, which typically have high pressure and greater driver blade velocity.

The cylinder 22 in the extended length tool has a length exceeding that of the driver blade 28. To keep the blade 28 generally centered during travel, at least two vertically extending stabilizing members 47 of the piston 24 contact the inner wall of the piston chamber or cylinder 22. However, the efficiency of energy transfer and piston velocity in a particular standard or extended cylinder tool is fixed by design. Between two different combustion powered tools, the stroke may be different and the separate tools might thereby develop different piston velocity and energy transfer efficiency. Similarly, altering the piston diameter, piston weight, combustion chamber volume, and initial combustion chamber pressure between two tool designs could alter the velocity and energy transfer between the tools.

In conventional tools, the fixed nature of the above-listed parameters prevents an operator from adjusting the driving depth of a fastener. The velocity of the piston 24 and driver blade 28 affect the driving depth, but the conventional tools fail to provide for adjustment of the velocity. An operator using such a tool is left without the ability to control driving depth, which may result in over-driven or under-driven fasteners. Moreover, when moving from a particular type of substrate, such as concrete, to another, such as steel, use of a commercially available combustion powered tool may result in an inconsistent driving depth. For these and similar reasons apparent to those skilled in the art, a tool with adjustable piston velocity would advantageously allow for control of fastener driving depth.

Providing for the adjustable control of piston velocity, the tool 10 of the present invention includes an exit port size adjustment ring 48 (best seen in FIG. 2). In the illustrated embodiment, the adjustment ring 48 fits over an outer sleeve 50. The sleeve 50 is snugly attached to an outer surface 54 of the cylinder 22, and includes circumferentially spaced holes 52 which correspond to the exit ports 40. Similarly, circumferentially spaced exit port openings 56 disposed between solid portions 58 of the adjustment ring 48 may be aligned with both the exit ports 40 and the holes 52. In the preferred embodiment, the adjustment ring 48 is knurled to provide a positive gripping surface.

Referring now to FIGS. 3–7, modification of the effective size of the exit ports 40 may be realized through rotational adjustment of the adjustment ring 48. To facilitate such adjustment, the adjustment ring 48 includes a plurality of laterally spaced positioning holes 60 configured and disposed to be engaged by a short pin 62 extending radially from an outer surface of the sleeve 50. Each of the separate positioning holes 60 represents a distinct rotational position of the adjustment ring 48. One of the positioning holes 60 may align the exit port openings 56 exactly with the exit ports 40. In this position, (best seen in FIG. 3) the exit ports 40 will be fully exposed, and the effective size of the exit ports 40 is at a maximum.

Maximum piston velocity, and fastener driving depth, is realized when the effective size of the exits ports 40 is maximized. In this condition, flow of the displaced volume of air or gas V being compressed and pushed downward by the piston 24 as it approaches the terminal end 32 is subject to the least resistance. Accordingly, the resistance to piston movement or back pressure caused by the displacement volume V is also at a minimum. Reduction of the effective size of the exit ports 40 through rotation of the adjustment ring 48 provides a more restricted path for flow of the displacement volume, and increases resistance to piston travel toward the terminal end 32. Through successive reductions of exit port effective size, an operator may realize successive reductions in driving depth in a given substrate. Additionally, consistent driving depth of fasteners into different types of substrates, such as wood and steel, may be obtained through alteration of the effective size of the exit ports 40.

Figure 7:
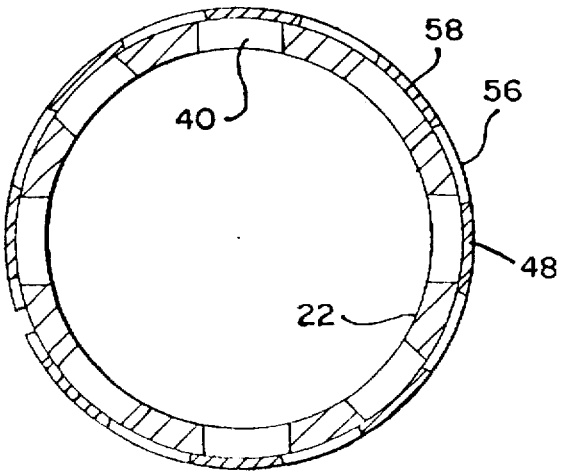

Successive reductions of the effective size of the exit ports 40 are illustrated schematically in FIGS. 4–7. As the adjustment ring 48 is moved in a counterclockwise manner, successive reductions of exit port effective size are obtained through varying degrees of alignment of the solid portions 58 of the adjustment ring 48 with the exit ports 40. In each of FIGS. 4–7, the solid portions 58 progressively cover, to an increasing degree, the exit ports 40. Each reduction of effective exit port size further restricts the path for flow of the displacement volume V out through the exit ports 40. Each reduction in exposure of the exit ports 40 reduces the effective size of the exits ports 40, and serves to reduce piston velocity. In FIG. 7, the exit ports 40 are essentially closed and as such provide the maximum reduction in piston velocity. In the illustrated embodiment, the adjustment ring 48 accomplishes the reduction of exit port effective size. It is contemplated that other mechanical structures for successively restricting the displacement volume flow path from the exit ports 40 in accordance with the present invention will be apparent to skilled artisans.

Figure 8:
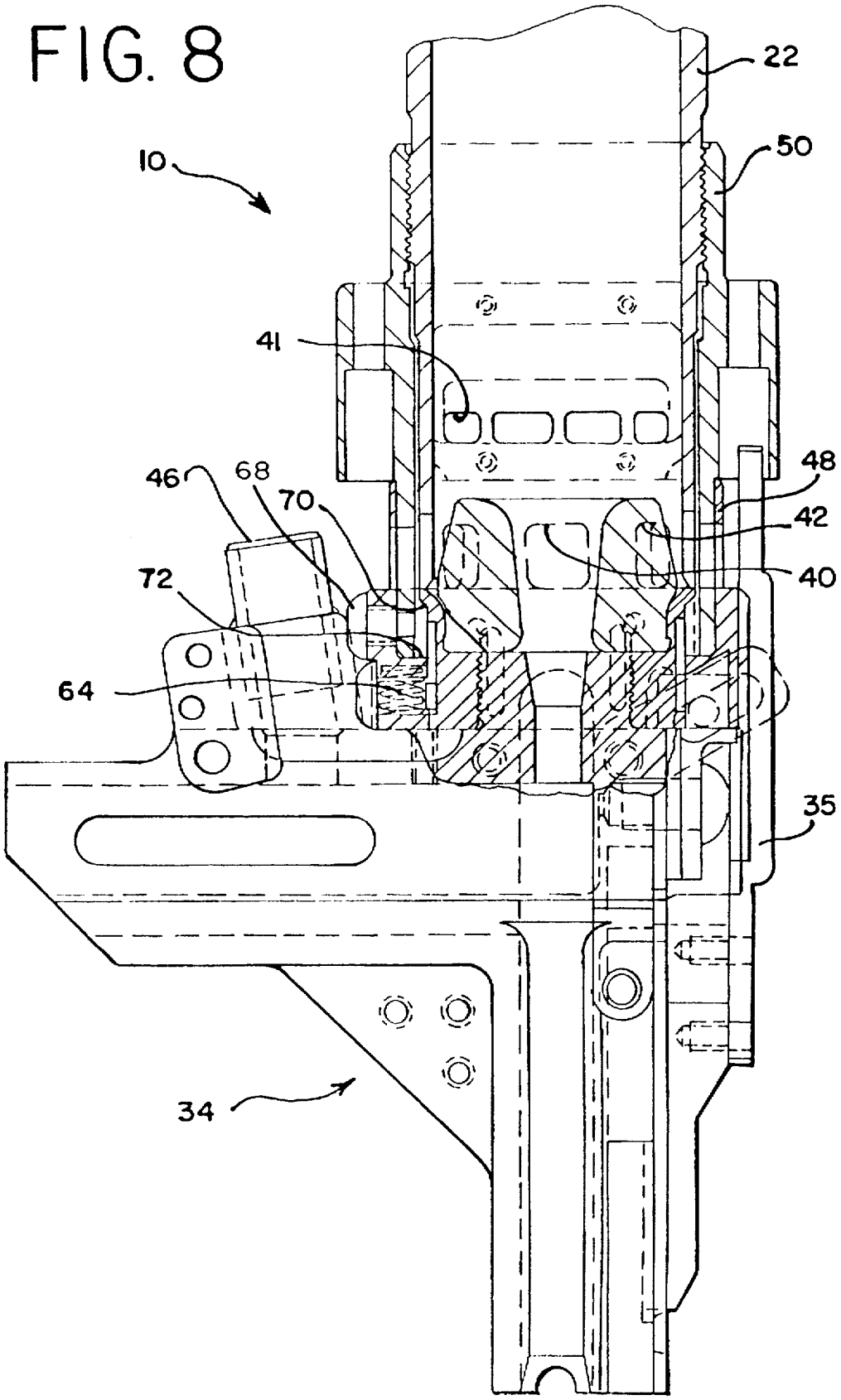
FIGS. 8 and 9 are assembled side views of the portion of the tool shown in FIG. 2, in different moments of tool operation.
Figure 9:
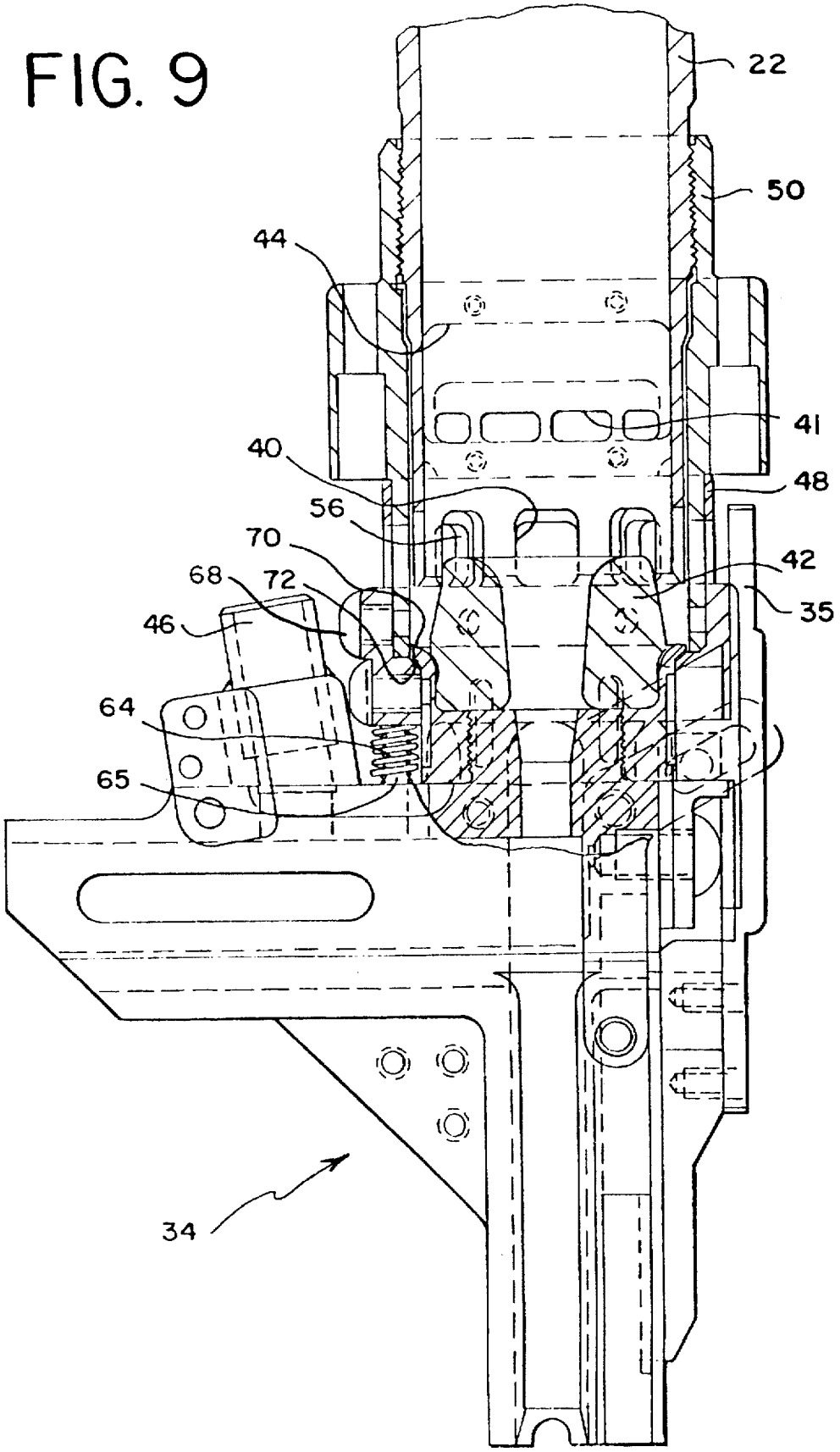

Referring now to FIGS. 2, and 8–9, an additional feature of the invention concerns the maintenance of the stability of the tool 10 with respect to a workpiece or substrate until the driver blade 28 strikes a fastener. If the tool moves with respect to the workpiece or substrate prior to impact, the transfer of power to the fastener, and angle of contact between the nosepiece 34 and the fastener may be adversely affected. Stability may be especially difficult to maintain in the extended length cylinder tools. In such tools, the piston 24 takes a longer time to travel to the terminal end 32 when compared to a shorter cylinder tool, and recoil of the tool 10 in response to the combustion can occur before the piston 24 has completed its travel, and before the driver blade 28 strikes the fastener.

During combustion, the energy released, pushes the piston 24 down and the tool up. In "standard length" combustion powered tools, this reaction is not felt by the user due to the greater mass of the tool relative to the force of impact. But in an extended length tool, the time between combustion and fastener impact is long enough that it is noticeable, and will move the tool up over ¼" by the time the driver blade 28 impacts the fastener. As discussed above, the longer length of the cylinder 22 in the present tool 10 allows the driver blade 28 to achieve, albeit over a longer time period, a velocity which is comparable to velocities achieved by competitive PAT tools, with their higher pressure and greater rates of acceleration.

Addressing this stability problem, the nosepiece 34 which positions and holds fasteners is mechanically isolated from the recoil of the remaining portions of the tool 10. At least one, and preferably a plurality of springs 64 allow the cylinder 22 to move independently of the nosepiece 34 within a limited range, while the nosepiece 34 remains stable. Each spring 64 is retained about a vertical lug 65 on the nosepiece 34. Set screws 66 attach a cylinder closure 68 to the sleeve 50 so that the cylinder closure 68 will move with the sleeve 50 and cylinder 22. The bumper 42 threads onto a nipple 69 of the nosepiece 34, with a flange 70 of the bumper 42 pressing against a shoulder 72 of the cylinder closure 68. Movement of the cylinder 22 toward the nosepiece 34 will compress the springs 64 as the cylinder closure 68 exerts force upon the springs 64. However, the bumper 42 and nosepiece 34 are mechanically isolated from this movement by the springs 64 and remain stable. Advantageously, the isolation serves to hold the nosepiece 34 and bumper 42 stable, even where the remaining portions of the tool 10 experience combustion recoil prior to impact of the driver blade 28 with a fastener.

This aspect of the invention is further illustrated in FIGS. 8 and 9. In FIG. 8, the cylinder closure 68 compresses the springs 64 in response to pressure applied by the operator in aligning the tool 10 for firing. In this position, the shoulder 72 moves downward and separates from the flange 70. The nosepiece 34 and bumper 42 remain stationary as the springs 64 become compressed. In FIG. 9, the situation upon combustion is indicated. Due to combustion-generated recoil, the springs 64 decompress, pushing the cylinder 22 and attached components upward. While the springs 64 relax, the driver blade 28 is allowed time to impact a fastener. The upward movement of the cylinder 22 is terminated by the engagement of the shoulder 72 against the flange 70. Thus, the nosepiece 34 and the bumper 42 remain stationary against the workpiece even during combustion. In this manner, the driver blade 28 is allowed sufficient time to travel down the cylinder 22, impact the fastener, and accurately drive it into the workpiece.

As described above with reference to the drawings, features of the present invention provide for user controlled adjustments to piston velocity, as well as mechanical isolation of the tool nosepiece to increase accuracy of fastener placement. While a particular embodiment of the velocity control and nosepiece stabilizer system for a combustion fastener powered tool of the invention has been shown and described, it will be appreciated by those skilled in the art that changes and modifications may be made thereto without departing from the invention in its broader aspects and as set forth in the following claims.

What is claimed is:

1. A combustion-powered fastener-driving tool, comprising:

a housing having a combustion chamber defined therein and enclosing a power source for creating combustion;

a cylinder operatively connected to said combustion chamber;

a piston movably disposed within said cylinder and adapted to be driven by said combustion developed within said combustion chamber;

a driver blade operatively connected to said piston so as to be driven by said piston toward a fastener so as to impact the fastener and drive the fastener into a workpiece;

a nosepiece configured for accepting said driver blade, for contacting the workpiece, and for guiding said driver blade so as to impact the fastener as said piston is driven toward a terminal end of said cylinder;

a bumper fixedly mounted upon said nosepiece for defining the end of travel of said piston within said cylinder when said piston is driven by said combustion toward said terminal end of said cylinder; and isolation means interposed between said nosepiece and said cylinder for isolating said nosepiece and said bumper from reactive movement of said cylinder, induced by said combustion of said sower source within said combustion chamber, by permitting said cylinder to undergo said reactive movement while said nosepiece and said bumper remaining substantially stationary with said nosepiece in contact with the workpiece after occurrence of said combustion and prior to impact and driving of the fastener by said driver blade.

2. The tool as defined in claim 1, wherein:

said isolation means comprises at least one spring which operatively connects said nosepiece to said cylinder.

3. The tool as defined in claim 2, wherein:

said at least one spring comprises a plurality of springs.

4. The tool as set forth in claim 3, wherein:

said nosepiece is provided with a plurality of upstanding lugs upon which said plurality of springs are respectively mounted.

5. The tool as defined in claim 1, further comprising:

a piston chamber defined within said cylinder and within which said piston is movable, and disposed on one side of said piston, while said combustion chamber is disposed upon an opposite side of said piston, said piston displacing a displacement volume of air ahead of said piston within said piston chamber as said piston advances within said piston chamber of said cylinder and toward said terminal end of said cylinder; and at least one displacement volume exit port, disposed within said cylinder, for allowing said displacement volume of air to exit said cylinder, ahead of said advancing piston, in a controlled manner.

6. The tool as set forth in claim 5, wherein:

said at least one displacement volume exit port comprises a plurality of circumferentially spaced exit ports.

7. The tool as set forth in claim 6, further comprising:

an adjustment ring, provided with a plurality of circumferentially spaced exit port openings and solid wall portions in an alternative array, rotatably mounted upon said cylinder between a first extreme position at which said exit port openings of said adjustment ring are fully aligned with said exit ports of said cylinder so as to permit unrestricted discharge flow of said displacement volume of air out from said cylinder, and a second extreme position at which said solid wall portions of said adjustment ring are substantially aligned with said exit ports of said cylinder so as to provide restricted flow discharge flow of said displacement volume of air out from said cylinder.

8. The tool as set forth in claim 7, wherein:

said adjustment ring is rotatably mounted upon said cylinder so as to be movable to a plurality of intermediate positions between said first and second extreme positions whereby a plurality of partially restricted volume flow positions are achieved.

9. The tool as set forth in claim 8, further comprising:

indicator means mounted upon said cylinder and said adjustment ring for visually indicating any one of said plurality of rotatable positions of said adjustment ring with respect to said cylinder.

10. The tool as set forth in claim 9, wherein said indicator means comprises:

a pin mounted upon said cylinder and projecting radially outwardly therefrom; and a plurality of holes defined within said adjustment ring and within which said pin is selectively disposed so as to visually indicate a predetermined rotatable position of said adjustment ring relative to said cylinder.

11. The tool as defined in claim 1 wherein:

said cylinder is provided with a length which is greater than the length of said driver blade so as to increase the stroke of the piston.

12. The tool as set forth in claim 1, wherein:

said nosepiece comprises an upstanding externally threaded nipple; and said bumper is fixedly mounted within an annular support member which is internally threaded for threaded mounting upon said externally threaded nipple of said nosepiece.

13. The tool as set forth in claim 12, wherein:

said cylinder comprises a cylinder closure member having an annular shoulder portion defined therein; and said annular support member for said bumper comprises an annular flanged portion for engaging said annular shoulder portion of said cylinder closure member when said cylinder undergoes said reactive movement so as to limit said reactive movement of said cylinder with respect to said nosepiece and said bumper.

* * * * *